US005204211A

United States Patent [19]

Horie et al.

[11] Patent Number: 5,204,211

[45] Date of Patent: Apr. 20, 1993

[54] IMAGE RECEIVER ELEMENT FOR USE IN SILVER SALT DIFFUSION TRANSFER

[75] Inventors: Ikutaro Horie; Hidetoshi Kobayashi, both of Kanagawa, Japan

[73] Assignee: Fuji Photo Film Co., Ltd., Kanagawa, Japan

[21] Appl. No.: 744,736

[22] Filed: Aug. 14, 1991

[30] Foreign Application Priority Data

Aug. 16, 1990 [JP] Japan ..... 2-216390

[51] Int. Cl.[5] ..... G03C 5/54; G03C 1/38

[52] U.S. Cl. ..... 430/232; 430/227; 430/634; 430/638; 430/641

[58] Field of Search ..... 430/232, 227, 233, 220, 430/216, 637, 638, 641, 634

[56] References Cited

U.S. PATENT DOCUMENTS 2,190,645 2/1940 Boomer ..... 430/637

3,752,692 8/1973 Young ..... 430/220

3,873,317 3/1975 Kato ..... 430/232

4,701,400 10/1987 Katoh ..... 430/227

4,945,026 7/1990 Tomiyama et al. ..... 430/232

*Primary Examiner*—Richard L. Schilling

*Attorney, Agent, or Firm*—Sughrue, Mion, Zinn, Macpeak & Seas

[57] ABSTRACT

An image receiving element for use in a peel-apart type silver salt diffusion transfer process comprising:

(a) a support having a front side and a back side;

(b) at least one layer which is a cellulose ester layer or a regenerated cellulose layer coated on the front side of the support;

(c) an aliphatic acid ester of glycerol contained in at least one of the cellulose ester layer or the regenerated cellulose layer; and (d) a gelatin-containing layer coated on the back side of the support.

5 Claims, No Drawings

IMAGE RECEIVER ELEMENT FOR USE IN SILVER SALT DIFFUSION TRANSFER

FIELD OF THE INVENTION

This invention relates to photographic materials for use in silver salt diffusion transfer processes. More particularly, it relates to an image receiving element for use in silver salt diffusion transfer processes which reduces curling of the photographic prints obtained by peel-apart type silver salt diffusion transfer processes.

BACKGROUND OF THE INVENTION

Diffusion transfer photographic processes in which a silver salt such as a silver halide is used are well known. In such photographic processes, an exposed photosensitive element containing a photographic emulsion of a silver halide is laminated with an image receiving element containing silver deposition nuclei and the inner part between these two elements is then processed with coating an alkaline processing solution containing a silver halide solvent in the presence of a developing agent, thereby causing a positive silver image to be formed directly on the image receiving element. In other words, the un-exposed portion of the silver halide emulsion in the photosensitive element is dissolved in the silver halide solvent contained in the alkaline processing solution to form a silver ion complex which is then transferred to the image receiving element. The thus transferred complex compound is deposited as a silver image in the image receiving element by the action of the silver deposition nuclei to form a positive image directly.

The image receiving element for use in such processes is generally prepared by superposing an image receiving layer on a paper support such as baryta paper, polyethylene laminate paper, lacquer paper, synthetic paper or the like, or on a film support such as acetyl cellulose, polyethylene terephthalate, polystyrene or the like. In this instance, the image receiving layer comprises an alkali permeable polymer binder which is selected from the group consisting of gelatin, carboxymethyl cellulose, hydroxyethyl cellulose, regenerated cellulose, polyvinyl alcohol, sodium alginate, starch, gum arabic, colloidal silica and the like, and a compound dispersed in the polymer binder which forms silver deposition nuclei and which is selected from another group consisting of metal sulfides such as palladium sulfide, nickel sulfide, silver sulfide and the like, or noble metal colloids such as colloids of gold, silver, palladium and the like.

For the purpose of improving such image receiving elements, a large number of techniques have been developed. In some of these techniques, regenerated cellulose is used as a binder for the image receiving element. For example, U.S. Pat. No. 3,179,517 discloses a process for the formation of an image receiving element in which a regenerated cellulose layer is prepared by hydrolyzing an acetyl cellulose film with an alkali and then the regenerated cellulose layer is soaked in a gold salt solution and a reducing agent solution to form silver deposition nuclei of gold colloid in the layer. JP-B-44-32754 (the term "JP-B" as used herein means an "examined Japanese patent publication") discloses an image receiving element which is prepared by providing silver deposition nuclei in a polymer material hardly permeable to alkali by means of vacuum deposition, dissolving the resulting polymer material in a solvent, coating and drying the dissolved mixture on a support and then hydrolyzing the surface layer of the thus formed polymer layer to give the layer alkali permeability.

JP-B-46-43944 discloses a process for the preparation of an image receiving element in which acetyl cellulose containing silver deposition nuclei in a dispersed form is coated on a support and then hydrolyzed to transform it into regenerated cellulose. Also, U.S. Pat. No. 4,163,816 discloses an image receiving element which is prepared by subjecting a solution of acetyl cellulose to acid hydrolysis in order to modify the cellulose material into a low acetylation degree acetyl cellulose and then coating the thus modified acetyl cellulose on a support.

In general, unlike typical photographic processes, the temperature at the time of exposure is the developing temperature in the case of diffusion transfer processes which, therefore, require a control means so that the developing time can be lengthened or shortened to correspond to low or high temperatures. To provide such control means, a neutralization layer to neutralize the alkali in the developing solution and a neutralization timing layer to control the alkali-neutralizing rate corresponding to the temperature are applied to the diffusion transfer process. In such a case, cellulose esters are frequently used as the neutralization timing layer and are also sometimes used as a binder for the neutralization layer.

As described above, acetyl cellulose or regenerated cellulose is well known as a binder for image receiving elements for use in silver salt diffusion transfer processes and is a very useful material.

The image receiving element for use in silver salt diffusion transfer processes must have a shading function in order to provide a light-free space as a "dark room" at the time of the development step. In the case of image receiving elements for use in peel-apart type silver salt diffusion transfer processes, such a shading function is generally incorporated into the support or its backing layer. In this instance, incorporation of the shading function into the backing layer may be most convenient, because obtainment of a support material having a shading function is relatively difficult, whereas many kinds of support materials having no shading function are on the market and can be obtained easily.

Backing layers having a shading function have been disclosed, for example, in U.S. Pat. No. 3,752,692 and JP-A-61-48845 (the term "JP-A" as used herein means an "unexamined published Japanese patent application). With regard to the shading agent, a black material which can absorb light over the entire visible radiation range, such as carbon black, is especially useful, but a black mixture prepared from single color dyestuffs such as yellow, magenta, cyan and the like may also be used. Though any water soluble or water insoluble polymer may be used as a binder in the dispersion or addition of the shading agent, it is desirable that the black layer be further superposed with another layer in which a white pigment is dispersed, because it is preferable to allow for writing (as by a pencil) on the backing layer and it is not preferable from an aesthetic point of view to have a black layer as the outermost layer. For this purpose, the use of water soluble polymers is preferable to the use of water insoluble polymers from an industrial point of view, because simultaneous coating of two or more layers can be carried out easily by dispersing or adding a shading agent and a white pigment in or to a water soluble polymer, especially gelatin.

However, the aforementioned image receiving element for use in silver salt diffusion transfer processes, in which a cellulose ester or regenerated cellulose is coated on the front side (developer-contacting side) of the image receiving element and a gelatin-containing layer is coated on the back side, has a disadvantage in that prints made from such an element are apt to curl and lose their flatness, because the materials comprising the front side layers and back side layers have greatly different degrees of expansion and contraction due to humidity and temperature, especially humidity.

In an image receiving element in which a cellulose ester is used, the hydrolyzing degree of the ester changes depending on environmental conditions and over time due to the presence of the alkali in the developing solution spread. In addition, an image receiving element containing acetyl cellulose is apt to shrink because acetyl cellulose releases acetic acid by alkali hydrolysis, which in turn causes a decrease in the volume of the element.

Curling of photographic prints causes inconveniences in many ways. For example, curled prints make it difficult to observe the image. Curled prints are difficult to mount for preservation as records, and are also difficult to file in a pasted form on a mount because the curled print tends to bow the mount.

This invention contemplates overcoming the aforementioned problems involved in the prior art.

SUMMARY OF THE INVENTION

In view of the above, a general object of this invention is to provide an image receiving element for use in a silver salt diffusion transfer process, which can prevent curling of the photographic print without deteriorating the surface state of the print.

To acheive the above and other objects, the present invention provides an image receiving element for use in a peel-apart type silver salt diffusion transfer process that comprises:

(a) a support having a front side and a back side;
(b) at least one layer which is a cellulose ester layer or a regenerated cellulose layer coated on the front side of the support;
(c) an aliphatic acid ester of glycerol contained in at least one of the cellulose ester layer or the regenerated cellulose layer; and
(d) a gelatin-containing layer coated on the back side of the support.

Other objects and advantages of the invention will become apparent as the description progresses.

DETAILED DESCRIPTION OF THE INVENTION

The inventors of the present invention have found that the aforementioned object can be achieved by developing an image receiving element for use in a silver salt diffusion transfer process in which at least one layer of a cellulose ester or regenerated cellulose is coated on the developer-contacting side of a support and at least one gelatin-containing layer is coated on the back side of the support, wherein at least one cellulose ester layer or regenerated cellulose layer contains an aliphatic acid ester of glycerol.

Aliphatic acid esters of glycerol can be regarded as a plasticizer. The present inventors have found that, unlike the case of other commonly known plasticizers, an aliphatic acid ester of glycerol has excellent compatibility with cellulose esters even when added in a liquid form to the cellulose ester layer. When a cellulose ester layer containing such an aliphatic acid ester of glycerol is applied to an image receiving element, the resulting print shows none of the unevenness which often results from the exudation of oily materials and which is common with typically used plasticizers. The aliphatic acid esters of glycerol have a significant effect in reducing curling of the print.

The aliphatic acid ester of glycerol suitable for use in the present invention may be selected from compounds represented by the following general formula (I):

$$\begin{array}{l} CH_2OCOR^1 \\ | \\ CHOCOR^2 \\ | \\ CH_2COOR^3 \end{array} \qquad (I)$$

wherein $R^1$, $R^2$ and $R^3$, which may be the same on different, each represents a linear or branched chain alkyl group having 1 to 7 carbon atoms.

Examples of $R^1$, $R^2$ and $R^3$ include methyl, ethyl, n-propyl, isopropyl, n-butyl, isobutyl, n-pentyl, n-hexyl, n-heptyl, 1-ethylpentyl and the like. $R^1$, $R^2$ and $R^3$ are preferably alkyl groups having 1 to 3 carbon atoms, more preferably methyl groups.

Illustrative examples of aliphatic acid esters of glycerol represented by general formula (I) are shown below:

$$\begin{array}{l} CH_2OCOCH_3 \\ | \\ CHOCOCH_3 \\ | \\ CH_2OCOCH_3 \end{array} \qquad \text{Compound (1)}$$

$$\begin{array}{l} CH_2OCOC_2H_5 \\ | \\ CHOCOC_2H_5 \\ | \\ CH_2OCOC_2H_5 \end{array} \qquad \text{Compound (2)}$$

$$\begin{array}{l} CH_2OCOC_3H_7(n) \\ | \\ CHOCOC_3H_7(n) \\ | \\ CH_2OCOC_3H_7(n) \end{array} \qquad \text{Compound (3)}$$

$$\begin{array}{l} CH_2OCOC_3H_7(i) \\ | \\ CHOCOC_3H_7(i) \\ | \\ CH_2OCOC_3H_7(i) \end{array} \qquad \text{Compound (4)}$$

$$\begin{array}{l} CH_2OCOC_4H_9 \\ | \\ CHOCOC_4H_9 \\ | \\ CH_2OCOC_4H_9 \end{array} \qquad \text{Compound (5)}$$

$$\begin{array}{l} CH_2OCOC_3H_7 \\ | \\ CHOCOCH_3 \\ | \\ CH_2OCOCH_3 \end{array} \qquad \text{Compound (6)}$$

$$\begin{array}{l} \qquad\quad C_2H_5 \\ \qquad\quad | \\ CH_2OCOCHC_4H_9 \\ | \qquad\quad C_2H_5 \\ \qquad\quad | \\ CHOCOCHC_4H_9 \\ | \qquad\quad C_2H_5 \\ \qquad\quad | \\ CH_2OCOCHC_4H_9 \end{array} \qquad \text{Compound (7)}$$

-continued

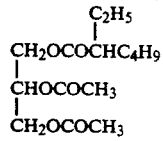

Compound (8)

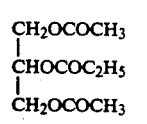

Compound (9)

The compounds represented by general formula (I) can be synthesized by a reaction of glycerol with an aliphatic acid chloride; by a dehydration condensation reaction of glycerol with an aliphatic acid; and by a transesterification reaction of glycerol with an aliphatic acid lower alkyl ester.

The aliphatic acid ester of glycerol may be used in an amount of from about 5 to about 40%, preferably from 15 to 30%, based on the weight of the cellulose ester or regenerated cellulose used as a binder.

According to the present invention, the image receiving element for use in the silver salt diffusion transfer process is preferably prepared by superposing an alkali neutralization layer, a neutralization timing layer and a silver deposition nuclei layer (image receiving layer) in that order on one side of a support and by superposing a shading layer and a white pigment layer in that order on the other side (back side) of the support. If necessary, additional layers may be laminated, such as an image stabilizing layer interposed between the alkali neutralization layer and the neutralization timing layer, a protection layer (stripping layer) on the silver deposition nuclei layer, and another protection layer on the white pigment layer on the back side of the support.

Support materials suitable for use in the present invention preferably have a certain level of waterproofing property which is at least equivalent to the waterproofing level of a polyethylene film having a thickness of 3 μm or more. Examples of such waterproof supports include a hydrophobic plastic film, a paper support on which a hydrophobic plastic film is laminated, and a paper support which is impregnated with a hydrophobic compound. Illustrative examples of hydrophobic plastic films include polyethylene, polypropylene, polystyrene, polycarbonate, polyethylene terephthalate, cellulose triacetate, cellulose diacetate and the like. When a hydrophobic plastic film is laminated on a paper support, polyolefins such as polyethylene and polypropylene are preferably used in view of the cost of production and an aptitude for lamination, with a laminated thickness of from about 3 to about 70 μm, preferably from 10 to 40 μm.

According to the present invention, any type of cellulose ester is suitable for use in an alkali neutralization layer, a neutralization timing layer and an image receiving layer before saponification, provided that the hydroxyl groups of cellulose are partially or totally esterified. Examples of these cellulose esters include aliphatic acid esters of cellulose such as cellulose acetate, cellulose propionate and the like and inorganic acid esters of cellulose such as cellulose sulfate, cellulose phosphate and the like.

A cellulose derivative having a desirable substitution degree of hydroxyl groups of cellulose into ester form may be selected from the above cellulose esters depending on the solvent composition to be used, the rate of the saponification reaction and the photographic activity of the image receiving layer (absorption rate of dissolved silver), though cellulose acetate is preferable in general. The substitution degree of cellulose acetate is preferably from 1.53 (acetylation degree, 40%) to 2.7 (acetylation degree, 58%), more preferably from 1.7 to 2.6.

According to the present invention, a polymer acid and the like may be used in the alkali neutralization layer. Such compounds are disclosed for example in JP-B-48-33697.

Preferable examples of polymer acids include maleic anhydride copolymers (such as a copolymer of styrene with maleic anhydride, a copolymer of methyl vinyl ether with maleic anhydride, a copolymer of ethylene with maleic anhydride, and the like); and acrylic and methacrylic acid copolymers (such as a copolymer of acrylic acid with alkyl acrylate, a copolymer of acrylic acid with alkyl methacrylate, a copolymer of methacrylic acid with alkyl acrylate, a copolymer of methacrylic acid with alkyl methacrylate, and the like). These polymer acids may be used alone in the alkali neutralization layer or as a mixture with a polymer hardly permeable to alkali such as a cellulose ester or with an alkali-permeable polymer.

The amount of the polymer acid to be applied, though the optimum amount varies depending on the amount of alkali contained in the developing solution, is preferably from 25 to 150 mol %, and more preferably from 40 to 100 mol %, based on the amount of alkali in the developing solution.

Well known compounds for use as the main component of neutralization timing layers include gelatin, polyvinyl alcohol, polyacrylamide, partially hydrolyzed polyvinyl acetate, a copolymer of β-hydroxyethyl methacrylate with ethyl acrylate, acetyl cellulose and the like, of which acetyl cellulose is particularly preferred.

A color tone agent may be used in the image receiving layer in which silver deposition nuclei are contained in a regenerated cellulose binder. Examples of such color tone agents are disclosed for instance in U.S. Pat. No. 3,756,825, German Patent 1,903,741, French Patent 2,090,476, JP-A-63-247755 and Photographic Silver Diffusion Transfer Processes (A. Rott and E. Weyde, Chapter 3.2.4.4, page 61–65; Focal Press, London, 1972).

For the purpose of improving the shelf life of print images prepared by silver salt diffusion transfer processes, an iodine ion capturing layer may be interposed between the image receiving layer and the support, or an image shelf life improving agent such as the agent disclosed in JP-A-59-231537 may be contained in the image receiving element.

A stripping layer or a protection layer may be superposed on the image receiving layer, in order to improve the gloss and smoothness of the surface of prints prepared by the silver salt diffusion transfer process and to protect the image receiving layer from abrasion.

According to the present invention, the back side of the support is laminated with a gelatin-containing layer, preferably a shading layer.

A shading layer may be obtained by coating a solution in which a black material such as carbon black or a dyestuff is dispersed in or added to gelatin. A white layer to be coated further on the shading layer may be obtained by coating a solution in which a pigment or a granular material having voids such as titanium white, calcium carbonate or the like is dispersed in gelatin.

These coating solutions may contain additives which are well known in the art, such as a surfactant, a thickener, a hardening agent, a softening agent, a wetting agent and the like. A protection layer may be coated on the outermost layer of the back side layers to prevent the shading layer and/or the white layer from being scratched and stripped by external forces. Preferably, this protection layer contains gelatin. A matting agent may be dispersed in the protection layer in order to give the layer writing ability and prevent the image receiving elements from cohering.

The gelatin derivative eligible for use in these backing layers may be selected from alkali processed gelatin, acid processed gelatin, enzyme processed gelatin and a gelatin derivative in which the amino groups or carboxyl groups are partially modified, of which alkali processed gelatin is particularly preferred.

The amount of black material which is used as a shading agent cannot be described in an absolute manner, but the preferable amount is selected such that the shading layer of a silver halide photographic light-sensitive material having a sensitivity of ISO 3000 can block light even when it is exposed to a light of 120,000 luxes for 10 seconds.

The amount of pigment or granular material to be used in the white layer for the purpose of concealing the black layer cannot be described in an absolute manner, but the pigment or granular material is preferably used in an amount sufficient to conceal the block color to a certain level so that lines of most colors written on the white layer using a pencil, a pen and the like can be recognized easily.

The amount of gelatin to be used in the back side layers of the support is preferably from 5 to 20 g/m$^2$. The amount of gelatin to be coated on the image receiving layer side is preferably almost the same as the amount on the back side on a solid weight basis.

Since diffusion transfer processes are well known their detailed description will be omitted herein.

Many kinds of photographic materials can be prepared by the diffusion transfer process. For example, a transferred image can be obtained by the following commonly known process: An image receiving element is laminated with a photosensitive material in which a photosensitive element containing a silver halide photographic emulsion is coated on a support. Subsequently, the inner sides of these two laminated elements are spread with an alkaline processing composition as a processing element, such as a high viscosity or low viscosity alkaline processing composition containing a developing agent and a silver halide solvent. This process may be effectively applied to the embodiment of the present invention.

The photosensitive element of the present invention comprises a photosensitive layer which contains at least one silver halide emulsion and is superposed on a support. Any photosensitive element known in this field of art can be applied to the present invention. A high sensitivity silver iodobromide (iodide content, 1 to 10 mol %) is the most preferable source of silver halide. Such a silver halide is dispersed in an appropriate protective colloid such as gelatin, casein, albumin, polyvinyl alcohol, polyacryl amide or the like. A suitable emulsion may be prepared in accordance with the processes disclosed for example in *Chimie et Physique Photographique* (P. Glafkides, published by Paul Montel, 1967), *Photographic Emulsion Chemistry* (G. F. Duffin, published by The Focal Press, 1966), and *Making and Coating Photographic Emulsions* (V. L. Zelikman et al., published by The Focal Press, 1964).

If necessary, the silver halide emulsion may be subjected to chemical sensitization, optical sensitization or supersensitization. The emulsion may also be mixed with various additives known in the art such as an antifogging agent, a hardening agent, a development accelerator, a surfactant, an antistatic agent and the like. A protection layer may be superposed on the photosensitive layer to protect the photosensitive layer from physical damage. A matting agent may be dispersed in the protection layer to improve slippage of the surface and to prevent cohering.

Various processing compositions, preferably, processing compositions containing a developing agent, a silver halide solvent and an alkali agent may be used as the processing element. As occasion calls, such a developing agent and/or silver halide solvent may also be contained in the photosensitive element and/or image receiving element.

Examples of appropriate silver halide developing agents include: benzene derivatives in which the ortho- or para-position of the benzene nucleus is substituted by at least two hydroxyl and/or amino groups (such as hydroquinone, amidol, methol, glycine, p-aminophenol and pyrogallol); and hydroxylamines, especially primary and secondary aliphatic and aromatic N-substituted or $\beta$-hydroxylamines which are soluble in water alkali (such as hydroxylamine, N-methylhydroxylamine, N-ethylhydroxylamine, the compounds disclosed in U.S. Pat. No. 2,857,276 and the N-alkoxyalkyl-substituted hydroxylamines disclosed in U.S. Pat. No. 3,293,034). Also useful are a hydroxylamine derivative having a tetrahydrofurfuryl group as disclosed in U.S. Pat. No. 3,864,131, aminoreductones as disclosed in German Patent Applications (OLS) 2,009,054, 2,009,055 and 2,009,078, a heterocyclic aminoreductone as disclosed in U.S. Pat. No. 4,128,425 and a tetraalkyl reductate as disclosed in U.S. Pat. No. 3,615,440.

These developing agents may be used alone or in combination with auxiliary developing agents such as a phenidone compound, a p-aminophenol compound and ascorbic acid.

Appropriate silver halide solvents may include typical fixing agents such as sodium thiosulfate, sodium thiocyanate, ammonium thiosulfate and other compounds disclosed in U.S. Pat. No. 2,543,181, as well as combinations of cyclic imides with nitrogen bases such as a combination of barbiturate or uracil with ammonia or an amine and the combination disclosed in U.S. Pat. No. 2,857,274. Also, 1,1-bissulfonyl alkane and its derivatives are known in the art and can be used as the silver halide solvent.

The processing composition contains alkali, preferably an alkali metal hydroxide such as sodium hydroxide or potassium hydroxide. When the processing composition is spread as a thin layer between the laminated photosensitive element and the image receiving element, the composition may preferably contain a polymer film forming agent, a concentrating agent or a thickening agent. For this purpose, hydroxyethyl cellulose or sodium carboxymethyl cellulose is especially useful and may be added to the processing composition in an amount effective to give an appropriate viscosity on the basis of the known principles of the diffusion transfer photographic process. The processing composition may further contain other additives known in the field of silver salt diffusion transfer processes, such as antifogging agents, stabilizers and the like.

EXAMPLES

The following examples are provided to illustrate the invention in further detail, but not by way of limitation.

In the following description, each value shown in "[ ]" indicates the coated amount of each component on a dry basis in $g/m^2$.

EXAMPLE 1

1. Preparation of Image Receiving Sheet

Image receiving sheets (A), (B), (C), (D) and (E) having the same construction of layers were prepared except that the composition of their neutralization layers was varied as described below.

One side (front side) of a polyethylene laminate support was coated with layers in the following order.

1) Neutralization Layer (A) [6.0] of a cellulose acetate (acetylation degree, 53%), [4.0] of a copolymer of methyl vinyl ether with maleic anhydride, and [0.04] of Uvitex OB (a trade name of Ciba-Geigy Ltd.)

(B) [2.5] of dibutyl phthalate further added to (A)

(C) [2.5] of tricresyl phosphate further added to (A)

(D) [2.5] of the compound (1) of the present invention further added to (A)

(E) [2.5] of the compound (2) of the present invention further added to (A)

2) Neutralization Timing Layer

[8.5] of a cellulose acetate (acetylation degree, 55%)

3) Image Receiving Layer

[2.0] of a cellulose acetate (acetylation degree, 53%) and [$7.5\times10^{-4}$] of palladium sulfide 4) Saponification Saponification was carried out by applying to the surface layer a solution prepared from 10.7 g of NaOH, 24 g of glycerol and 280 ml of methanol.

5) Stripping Layer

[0.04] of a copolymer of butyl methacrylate with acrylic acid (molar ratio, 15:85)

After completion of the lamination steps of the above layers on the front side of the support, the back side of the support was coated with back side layers in the following order:

6) Shading Layer

[4.0] of carbon black and [10.0] of gelatin

7) White Layer

[6.0] of titanium dioxide and [2.1] of gelatin

2. Preparation of Photosensitive Sheet

Two layers were coated on a support (a black polyester film) in the following order:

1) Photosensitive Layer

[0.59 as silver content basis] of silver iodobromide (iodine content, 6.5 mol %) having an average particle size of 1.0 μm and [3.5] of gelatin 2) Protection Layer

[0.7] of gelatin and [0.1] of polymethyl methacrylate particles

3. Preparation of Processing Solution

The composition of the processing solution was as follows:

| | |
|---|---|
| Aqueous solution of potassium hydroxide (40%) | 323 ml |
| Titanium dioxide | 3 g |
| Hydroxyethyl cellulose | 79 g |
| Zinc oxide | 9.75 g |
| N,N-bis-methoxyethylhydroxyamine | 75 g |
| Aqueous solution of triethanolamine (6.2 parts of water and 4.5 parts of triethanolamine) | 17.14 g |
| Tetrahydropyrimidinethion | 0.4 g |
| 2,4-Dimercaptopyrimidine | 0.35 g |
| Uracil | 80 g |
| Water | 1193 g |

The photosensitive sheet prepared above was exposed to light using a sensitometer having a light source having a color temperature of 5400K, the thus exposed photosensitive sheet was laminated with the image receiving sheet prepared above and then the space between these two sheets was filled with the processing solution prepared above in a thickness of 0.05 mm to start diffusion transfer development. A positive image was obtained by separating (stripping) the image receiving sheet from the photosensitive sheet 30 seconds after the commencement of development under an atmosphere of 25° C. In this manner, prints (A), (B), (C), (D) and (E) were obtained (three sheets for each). Firstly, the surface state of each print was observed with naked eyes, with the results shown in Table 1.

TABLE 1

| Image receiving sheet | Surface state of print: Surface state of print |
|---|---|
| A | Good |
| B | Unevenness due to exudation of oily material |
| C | Unevenness due to exudation of oily material |
| D | Good |
| E | Good |

The three sheets of each print were separately put in chambers controlled at 80% RH, 60% RH and 20% RH, respectively, and stored at 25° C. After 8 days of the storage, the curling degree of each print was evaluated under the following conditions.

1) Curling is approximated as a part of circle. The curling degree is regarded as positive when the center of the approximated circle is on the image side, and as negative when the center of the circle is on the opposite side.

2) The curling degree is expressed in terms of the maximum height (mm) when each print is stood still on a horizontal plane. Smaller absolute value means smaller curling and therefore preferable print conditions.

Results of the evaluation of curling degree of the image receiving sheets (A) to (E) under different storing conditions are shown in Table 2.

TABLE 2

| Image receiving sheet | Curling of prints: Storing condition (8 days) 25° C., 80% RH | 25° C., 60% RH | 25° C., 20% RH |
|---|---|---|---|
| A | +44 | +19 | −2 |
| B | +23 | +14 | −3 |
| C | +23 | +13 | −2 |
| D | +19 | +10 | +1 |
| E | +20 | +12 | +2 |

As is evident from Tables 1 and 2, the image receiving sheets D and E in which a compound of the present invention is used in their neutralization layers reduced the degree of print curling without deteriorating the surface state of the print.

EXAMPLE 2

Image receiving sheets (F), (G), (H) and (I) were prepared as follows.

One side (front side) of a polyethylene laminate paper as a support was coated with layers in the following order:

1) Neutralization Layer (F) [6.0] of a cellulose acetate (acetylation degree, 53%), [4.0] of a copolymer of methyl vinyl ether with maleic anhydride and [0.04] of Uvitex OB (a trade name of Ciba-Geigy Ltd.)

(G) [4.0] of the compound (3) of the present invention further added to (F)

(H) the same as (F)

(I) the same as (F)

2) Cationic Polymer Electrolyte Layer (F) [4.2] of a cellulose acetate (acetylation degree, 46%) and [2.1] of a cationic polymer electrolyte represented by the following general formula

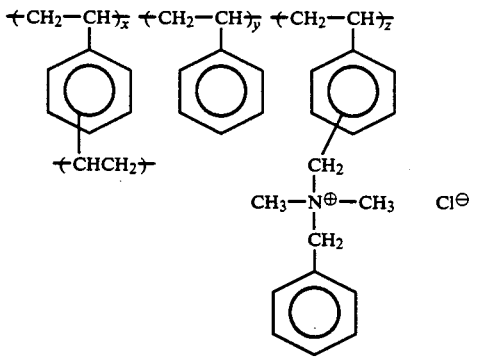

x:y:z = 10:45:45
(molar ratio)

(G) the same as (F)

(H) [4.0] of the compound (3) of the present invention further added to (F)

(I) the same as (F)

3) Neutralization Timing Layer (F) [8.5] of a cellulose acetate (acetylation degree, 55%) and [0.06] of 1-(4-hexylcarbamoylphenyl)-2,3-dihydroimidazole-2-thion (G) the same as (F)

(H) the same as (F)

(I) [4.0] of the compound (3) of the present invention further added to (F)

4) Image Receiving Layer

The image receiving layer was prepared by coating [1.5] of a cellulose acetate (acetylation degree, 53%), [$8.0\times10^{-4}$] of palladium sulfide and [0.06]of 1-(4-hexylcarbamoylphenyl)-2,3-dihydroimidazole-2-thion on the neutralization timing layer and then saponificating the surface layer with a saponification solution prepared by dissolving 9.0 g of sodium hydroxide in 300 ml of methanol.

5) Stripping Layer

[0.03] of a copolymer of butyl methacrylate with acrylic acid (molar ratio, 15:85)

After completion of the lamination steps of the above layers on the front side of the support, the back side of the support was coated with back side layers in the following order:

6) Shading Layer

The same composition as in Example 1 was used.

7) White Layer

The same composition as in Example 1 was used.

Exposure and subsequent diffusion transfer development were carried out in the same manner as in Example 1 using the same photosensitive sheet and processing solution as used in Example 1. A positive image was obtained by separating the image receiving sheet from the photosensitive sheet 3 minutes after the commencement of the development under an atmosphere of 25° C.

Prints (F), (G), (H) and (I) obtained in this manner showed good surface state.

Prints (F) to (I) were stored for 14 days with daily changes in the humidity (80% RH in every odd-numbered day and 20% RH in every even-numbered day after the commencement of the test), and the thus stored prints were checked for their curling degrees in the same manner as described in Example 1. The results are shown in Table 3.

TABLE 3

| Image receiving sheet | Curling of print: Storage conditions 25° C., 20% RH (13 days) | 25° C., 80% RH (14 days) |
|---|---|---|
| F | +45 | +37 |
| G | +20 | +14 |
| H | +19 | +12 |
| I | +18 | +12 |

As is evident from Table 3, the image receiving sheets (G), (H) and (I) in which a compound of the present invention is used in any one of the front side layers of the image receiving element reduced the degree of print curling without deteriorating the surface state of the print.

Thus, it is apparent that there has been provided, in accordance with the present invention, an image receiving element for use in silver salt diffusion transfer processes, in which an aliphatic acid ester of glycerol is used in the image receiving layer. By the use of such a glycerol-based aliphatic acid ester, curling of photographic prints can be prevented without deteriorating the surface state of the prints.

While the present invention has been described in detail and with reference to specific embodiments thereof, it is evident that many alternatives, modifications and variations will be apparent to those skilled in the art in light of the foregoing description. Accordingly, it is intended to include all such alternatives, modifications and variations within the spirit and scope of the appended claims.

What is claimed is:

1. An image receiving element containing silver deposition nuclei for use in a peel-apart type silver salt diffusion transfer process comprising:

(a) a support having a front side and a back side;

(b) at least one layer which is a cellulose ester layer or a regenerated cellulose layer coated on the front side of the support;

(c) an aliphatic acid ester of glycerol contained in at least one of the cellulose ester layer or the regenerated cellulose layer; and (d) a gelatin-containing layer coated on the back side of the support; wherein the aliphatic acid ester of glycerol is selected from the group of compounds represented by general formula (I):

$$\begin{array}{l} CH_2OCOR^1 \\ | \\ CHOCOR^2 \\ | \\ CH_2COOR^3 \end{array} \qquad (I)$$

wherein $R^1$, $R^2$ and $R^3$, which may be the same or different, each represents a linear or branched chain alkyl group having 1 to 7 carbon atoms.

2. The image receiving element of claim 1, in which each of $R^1$, $R^2$ and $R^3$ represents a methyl group.

3. The image receiving element of claim 1, in which the amount of aliphatic acid ester of glycerol is from 5 to 40% of the weight of the cellulose ester or regenerated cellulose.

4. The image receiving element of claim 1, in which the amount of aliphatic acid ester of glycerol is from 15 to 30% of the weight of the cellulose ester or regenerated cellulose.

5. The image receiving element of claim 1, in which the gelatin-containing layer includes carbon black.

* * * * *